US006706149B2

(12) United States Patent
Dick et al.

(10) Patent No.: US 6,706,149 B2
(45) Date of Patent: Mar. 16, 2004

(54) WEB MONITORING

(75) Inventors: Wolfram Dick, Nattheim (DE); Roland Mayer, Heidenheim (DE); Holger Prüssing, Aalen (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/175,951

(22) Filed: Jun. 21, 2002

(65) Prior Publication Data

US 2003/0000671 A1 Jan. 2, 2003

(30) Foreign Application Priority Data

Jun. 28, 2001 (DE) ..... 101 31 281

(51) Int. Cl.[7] ..... D21F 7/04
(52) U.S. Cl. ..... 162/198; 162/255; 162/263
(58) Field of Search ..... 162/198, 199, 162/263, 272, 252, 253, 306, 359.1, 358.1, 255, 262; 226/11; 250/339.63, 339.64, 352, 370.15; 34/445, 446, 487, 491, 524, 525, 556, 575; 700/127, 128, 129

(56) References Cited

U.S. PATENT DOCUMENTS 3,016,622 A * 1/1962 Gade et al. ..... 34/525
5,190,201 A * 3/1993 Briggs ..... 226/1
5,280,720 A * 1/1994 Heidt ..... 73/159
5,862,608 A * 1/1999 Kotitschke ..... 34/117
5,942,689 A * 8/1999 Bonissone et al. ..... 73/598

FOREIGN PATENT DOCUMENTS

DE 4126601 2/1993
DE 4126601 A1 * 2/1993 ..... G01B/11/00

* cited by examiner

*Primary Examiner*—Steven P. Griffin
*Assistant Examiner*—Eric Hug
(74) *Attorney, Agent, or Firm*—Greenblum & Bernstein P.L.C.

(57) ABSTRACT

A process and device to detect the presence of a fibrous material web in machines for manufacturing the same, whereby the fibrous material web is guided by at least one continuously circulating belt. The process includes measuring at least one of (1) a temperature of a side of the fibrous material web opposite the at least one belt while it is being supported by the at least one belt, (2) a temperature of a material web supporting side of the side of the at least one belt after transfer of the fibrous material web to a following unit, and (3) the temperature of a side of the at least one belt opposite the fibrous material web supporting side of the at least one belt. The process also includes detecting a change in the at least one measured temperature as an indicator of the presence or lack of fibrous material or the strip in an area in the machine in the vicinity of the measuring.

41 Claims, 1 Drawing Sheet

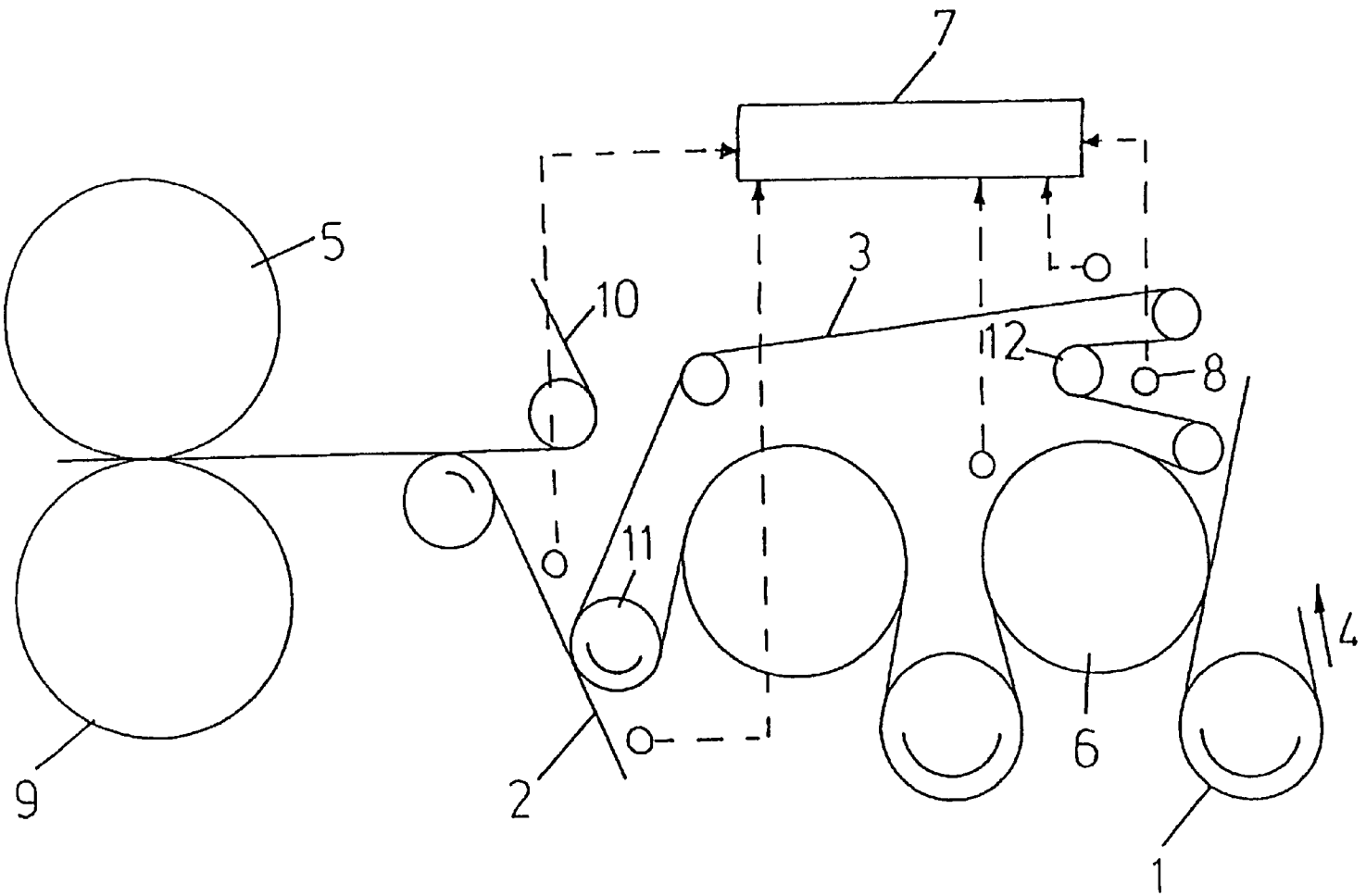
1
2
3
4
5
6
7
8
9
10
11
12

WEB MONITORING

CROSS-REFERENCE TO RELATED APPLICATIONS

The present application claims priority under 35 U.S.C. §119 of German Patent Application No. 101 31 281.4, filed on Jun. 28, 2001, the disclosure of which is expressly incorporated by reference herein in its entirety.

BACKGROUND OF THE INVENTION

1. Field of the Invention

The invention relates to a process to detect the presence of a paper, cardboard, tissue or other fibrous material web or a strip of the fibrous material web in machines for manufacturing and/or finishing the fibrous material web, whereby the fibrous material web is guided by at least one continuously circulating belt.

2. Discussion of Background Information

In order to be able to minimize the damage from a tear in the fibrous material web, it is important to detect the tear as early as possible. This makes it possible not just to reduce possible damage to the machine from a jam of the fibrous material web, but also to reduce the broke. In addition, it is also important for the control of the machine to detect the complete transfer of the fibrous material web when starting the machine.

In general, monitoring of the fibrous material web takes place on the basis of optical sensors or camera analysis systems. To this end, the belts are often designed in colors, which is intended to improve the recognizability of the fibrous material web. The reliability of the optical detection is impaired, however, by the contamination of the belts, the mostly warm, moist and contaminated air in the area of the machine as well as the contamination of the sensors or cameras. In addition to the high price of the measuring units, their reliability is unsatisfactory.

SUMMARY OF THE INVENTION

The invention therefore creates a process and a device to detect the presence of a fibrous material web or a strip thereof, which offer improved reliability with the use of a simple device.

According to the invention, in that the detection of the presence of a fibrous material web or a strip thereof takes place in an area of the machine in which the lack of the fibrous material web or a strip thereof or the successful transfer of the fibrous material web produces a change in the temperature of the belt, and detection takes place based on the measurement of the temperature of the side of the fibrous material web opposite the belt while it is being supported by the belt and/or the temperature of the side of the belt facing the fibrous material web after transfer of the fibrous material web to a following unit and/or the temperature of the side of the belt opposite the fibrous material web. This occurs on the basis of the knowledge that the temperature of the belt changes relatively quickly with the lack or addition of the fibrous material web or a strip thereof. In this process, at least one temperature sensor is allocated to the belt to measure the temperature of the side of the fibrous material web opposite the belt while it is being supported by the belt and/or the temperature of the side of the belt facing the fibrous material web after transfer of the fibrous material web to a following unit and/or the temperature of the side of the belt opposite the fibrous material web. Temperature sensors are substantially cheaper and more reliable than optical sensors.

The use of the process and the device is possible, in particular, where at least the temperature of the side of fibrous material web that is directed away from the belt deviates from the temperature of the belt. Above all, at least the temperature of the area of the belt touched by the fibrous material web should deviate from the temperature of the fibrous material web, at least, however, from the temperature of the side of the fibrous material web that is directed away from the belt.

This monitoring of the fibrous material web by use of temperature measurement can be realized inside the machine on several belts as well. A tear of the fibrous material web can thus be detected very early. Also advantageous is the use with the acceptance of the fibrous material web by the belt in order to establish that the leader strip is running across the width and that the fibrous material web has completely transferred when starting the machine.

In order to increase the reliability of the measuring arrangement, the temperature measurement can take place at several locations along the run of the belt and/or at several locations crosswise to the belt travel direction. The arrangement of several temperature measuring locations crosswise to the belt travel direction also permits monitoring of individual zones of the fibrous material web, so that the transfer of the strip of the fibrous material web that is getting wider can be relatively precisely detected when starting the machine.

The temperature measurement should be accomplished without contact so as not to impair the belt or the fibrous material web. Temperature sensors in the form of IR sensors or IR thermography cameras are particularly suitable for this. In this connection, a cleaning element, preferably in the form of an air jet, and/or a cooling element, can be allocated to the temperature sensors. Both substantially increase the reliability of the measurement. The temperature sensors should feature a measuring area with a diameter between about 20 and 200 mm, preferably between about 20 and 100 mm.

If several temperature sensors are present for temperature monitoring of a larger area, in particular, crosswise to the belt travel direction, the distance between two temperature sensors should be between about 100 and 1000 mm, preferably between about 200 and 600 mm. The sensors can also be arranged at several particularly interesting locations, for example in the edge areas of the fibrous material web shortly before and/or after an airborne web dryer or drying hood or the like. In addition, it can also be an advantage if at least one temperature sensor is embodied to be traversable crosswise to the fibrous material web. The temperature can thus be detected via this temperature sensor at least over a portion of the width of the belt or the fibrous material web.

In order to be able to improve the reliability even more, two temperature sensors instead of one can also be arranged very close together, whereby only the temperature changes that are detected by both temperature sensors are evaluated.

The use of temperature measurement is advantageous for fibrous material web detection in the area of the press section for dewatering the fibrous material web, whereby the belt is embodied as a press felt or a transfer belt. This applies in particular where the fibrous material web is heated before the temperature measurement by at least one heating element, preferably in the form of a heated press roll, a steam blower box or the like.

The use of the process and the device can also be accomplished advantageously in the area of a dryer section for drying the fibrous material web, whereby the belt is embodied as a drying screen. This provides a high degree of reliability of the process if before the temperature measurement the fibrous material web is heated by at least one heating element, preferably in the form of an IR radiator, a heated drying cylinder, hot-air jets or the like.

In general, but particularly in the described arrangements, in the press section and dryer section the temperature of the belt before contact with the fibrous material web is lower than that of the fibrous material web. It is thereby possible for the temperature of the belt to drop at least in the area touched by the fibrous material web when the fibrous material web or at least a part thereof is missing in the affected section. Depending upon the type of arrangement, it is also possible, however, that, due to the direct contact with the heating element, the temperature of the belt quickly increases at least in the area touched by the fibrous material web when the fibrous material web or at least a part thereof is missing in the affected section. If the fibrous material web is to be cooled, e.g., by a blower, the temperature conditions between the fibrous material web and the belt change accordingly.

The result of the temperature measurement should be supplied to a control unit, which evaluates the temperature change. Here it is advantageous if the temperature of the belt outside the area touched by the fibrous material web is also measured for determining a temperature comparison value.

The rate/rapidity and/or the extent of the temperature change are used to detect the lack of the part of the fibrous material web running at least in the area of the temperature measurement. Thus, in particular a tear in the fibrous material web produces a jump in the temperature of the belt. Corresponding temperature changes are also produced, however, when threading the fibrous material web.

As far as the control unit is concerned, a temperature change of at least 2° C., preferably at least 5° C., within a period of a maximum of 3 s, preferably a maximum of 1 s, and in particular a maximum of 0.3 s, indicates the lack of or addition of at least the part of the fibrous material web running in the area of the temperature measurement. However, this also applies to a temperature change within a time of a maximum of 3 s, preferably a maximum of 1 s, of at least 2° C., preferably at least 5° C., and in particular of at least 10° C.

In addition, the control unit can evaluate the rate/rapidity of the temperature change in order to detect the location of a tear in the fibrous material web, whereby, e.g., a quick change in the dryer section indicates a large distance to the location of the tear, because when the fibrous material web is missing, the drying screen of the drying group is heated by all the drying cylinders of the same. The extent of the temperature change can also be taken into consideration in this connection, because a large jump in temperature in most cases indicates a large distance to the location of the tear. However, it must be taken into account that the rapidity of the temperature change also depends upon the machine speed, the type of belt and the dry content of the fibrous material web.

If the measurement of the temperature of the belt takes place after the transfer of the fibrous material web, this should occur as quickly as possible afterward, so as to minimize outside influences on the temperature as well as the reaction time. This measuring location offers particular advantages with respect to the spatial freedom of design.

In any case, the control unit should supply a signal when detecting a tear in the fibrous material web, which signal triggers a routine, preferably the transition into tear operation and/or the diversion of the fibrous material web and/or the shut-off of the machine or at least a part thereof.

The heating capacity of the drying device can be controlled in tear operation on the basis the belt temperature. In this connection, an overheating as well as too strong a cooling should be avoided in order to thereby optimize the starting process.

When detecting the successful transfer of the entire fibrous material web, the control unit should supply a signal, which triggers a routine, in particular, the transition to the normal operation of the machine or at least a part thereof, for example raising the heating capacity.

According to an aspect of the present invention a process is provided to detect the presence of one of a paper, cardboard, tissue or other fibrous material web or a strip of the fibrous material web in machines for at least one of manufacturing and finishing the fibrous material web, whereby the fibrous material web is guided by at least one continuously circulating belt. The process includes measuring at least one of (1) a temperature of a side of the fibrous material web opposite the at least one belt while it is being supported by the at least one belt, (2) a temperature of a material web supporting side of the side of the at least one belt after transfer of the fibrous material web to a following unit, and (3) a temperature of a side of the at least one belt opposite the fibrous material web supporting side of the at least one belt. The process also includes detecting a change in the at least one measured temperature as an indicator of the presence or lack of fibrous material or the strip in an area in the machine in the vicinity of the measuring.

According to another aspect of the present invention, the at least one belt includes a plurality of belts and the temperature measurement takes place on several of the plurality belts. Furthermore, another aspect of the present invention includes the temperature measurement taking place at several locations along a run of the at least one belt. In yet another aspect of the present invention the temperature measurement takes place at several locations crosswise to a direction of travel of the at least one belt. In another aspect of the present invention the temperature measurement takes place without contact with respect to the at least one belt. According to a further aspect of the present invention the temperature measurement takes place in an area of a press section for dewatering the fibrous material web, wherein the at least one belt comprises a press felt or a transfer belt.

In another aspect of the present invention, the process further includes heating the fibrous material web before the temperature measurement by at least one heating element. According to a still further aspect of the present invention, the at least one heating element includes at least one of a heated press roll and a steam blower box. According to other aspects of the present invention, the temperature measurement takes place in the area of a dryer section for drying the fibrous material web, wherein the at least one belt comprises a drying screen. Further aspect of the present include heating the fibrous material web before the temperature measurement by one of an IR radiator, a heated drying cylinder, and hot-air jets. According to other aspects of the present invention include wherein a temperature of the at least one belt in normal operation of the machine is lower than a temperature of the fibrous material web.

According to another aspect of the present invention, wherein the temperature of a region of the at least one belt structured to support the material web drops when the fibrous material web or at least a part thereof is no longer present in the region. In yet another aspect of the present invention, wherein, due to direct contact with the at least one heating element, the temperature of a region of the at least one belt structured to support the material web increases when the fibrous material web or at least a part thereof is missing in the region. According to a further aspect of the present invention, the process further includes supplying a result of the temperature measurement to a control unit, which evaluates the temperature measurement.

In another aspect of the present invention, the process further includes measuring the temperature of the at least one belt outside an area structured to support the fibrous material web in order to determine a temperature comparison value. According to a still further aspect of the present invention, detecting the temperature change includes at least one of a rate and a magnitude of the temperature change. Other aspect include wherein a temperature change of at least 10° C. within a period of a maximum of 3 s indicates the lack of or addition of at least the part of the fibrous material web running in the area of the temperature measurement. Further aspects of the present invention include wherein a temperature change of at least 5° C. within a maximum period of 1 s, indicates the lack of or addition of at least the part of the fibrous material web running in the area of the temperature measurement. According to other aspects of the present invention, a temperature change of at least 5° C. within a maximum period of 0.3 s, indicates the lack of or addition of at least the part of the fibrous material web running in the area of the temperature measurement.

According to another aspect of the present invention at least one of the magnitude and rate of the temperature change is evaluated to detect the location of a tear in the fibrous material web. According to a further aspect of the present invention, the measurement of the temperature of the at least one belt takes place as quickly as possible after the transfer of the fibrous material web. According to a still further aspect of the present invention, when detecting a tear in the fibrous material web, the control unit triggers a routine comprising at least one of: (1) transitioning into a tear operation, (2) reducing the heating capacity, (3) diverting the fibrous material web, and (4) shutting at least a part of the machine off. In yet another aspect of the present invention, when a tear is detected the heating capacity is controlled depending on the temperature of the at least one belt. In another aspect of the present invention, the unit supplies a signal when detecting a successful transfer of the entire fibrous material web, which signal triggers a transition to the normal operation of the machine or at least a part of the machine.

According to another aspect of the present invention, a device is provided to detect the presence of at least one of a paper, cardboard, tissue or other fibrous material web or a strip of the fibrous material web in machines for at least one of manufacturing and finishing the fibrous material web, whereby the fibrous material web is guided by at least one continuously circulating belt. The device includes at least one temperature sensor located in an area in the machine in which the lack of or addition of the fibrous material web or a strip thereof produces a change in the temperature of the at least one belt; and the at least one temperature sensor being arranged to measure at least one of (1) a temperature of a side of the fibrous material web opposite the at least one belt while it is being supported by the at least belt, (2) a temperature of a web supporting side of the at least belt after transfer of the fibrous material web to a following unit, and (3) a temperature of the side of the at least one belt opposite the web supporting side of the at least one belt.

According to another aspect of the present invention, the at least one temperature sensor includes at least one of IR sensor and IR thermography camera. In yet another aspect of the present invention, the device includes a cleaning element located proximate to the at least one temperature sensor. Additionally, other aspects of the present invention include the cleaning element being an air jet. Moreover, another aspect of the present invention includes a cooling device allocated to said at least one temperature sensor. In yet another aspect of the present invention, the at least one temperature sensor includes a plurality of temperature sensors arranged next to one another crosswise to the belt travel direction. In another aspect of the present invention, the distance between each temperature sensor is between about 100 mm and 1000 mm. Also in another aspect of the present invention, the distance between each temperature sensor is between about 200 mm and 600 mm. And yet in another aspect of the present invention, the at least one temperature sensor has a measuring area with a diameter between about 20 mm and 200 mm. In another aspect of the present invention, the at least one temperature sensor has a measuring area with a diameter between about 20 mm and 100 mm.

According to still a further aspect of the present invention, the at least one temperature sensor includes two temperature sensors arranged close to one another as a pair. According to another aspect of the present invention, the at least one temperature sensor is embodied to be traversable crosswise to the fibrous material web. In yet another aspect of the following invention, the at least one temperature sensor includes a temperature sensor located on opposite sides of a transfer roll. According to a further aspect of the present invention, the at least one temperature sensor is located in a press section of the machine.

According to a still further aspect of the present invention, the at least one temperature sensor is located in a dryer section of the machine. In another aspect of the present invention, the at least one temperature sensor is located to measure a temperature of the side of the at least one belt opposite the web supporting side of the at least one belt, where the at least belt is supported by a heated drying cylinder. In yet another aspect of the present invention, the at least one temperature sensor is located to measure a temperature of the side of the at least one belt opposite the web supporting side of the at least one belt, where the at least one belt is unsupported.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

The FIGURE shows a schematic representation of the transition between the press section and dryer section of a paper machine with possible arrangements of temperature sensors.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The press section is used to dewater the fibrous material web 1, whereby the fibrous material web 1 in this case runs through a press nip formed by two press rolls 5, 9 on both sides each with a belt 2, 10 in the form of a water-absorbing press felt.

For example, the upper press roll 5 is heated in this case to intensify the dewatering. The heat is transferred to the fibrous material web 1 via the continuously circulating upper belt 10.

This upper belt is diverted from the fibrous material web 1 after the press nip, and the fibrous material web 1 is supported only by the lower belt 2. The fibrous material web 1 is transferred by the belt 2 to a belt 3 of the following drying group of the dryer section. The belt 3 is embodied as a continuously circulating, air-permeable drying screen, whereby the transfer of the fibrous material web 1 is supported by a suction guide roll 11 wound about by the drying screen.

Temperature sensors 8 are arranged before and after the transfer of the fibrous material web 1 in the area of the belt 2 releasing the fibrous material web 1. These temperature sensors 8 are attached on the side of the belt 2 touched by the fibrous material web 1. The temperature sensor 8 can detect a tear in the fibrous material web 1 before the transfer of the fibrous material web 1. Due to the heating of the fibrous material web 1 by the heating element located upstream in the form of the heated press roll 5, the temperature of the fibrous material web 1 is higher than that of the area of the belt 2 touched by the fibrous material web 1. In normal operation the temperature sensor 8 detects the relatively high temperature of the fibrous material web 1 before the transfer of the fibrous material web 1. However, if a tear occurs before the press nip, this temperature sensor 8 detects the lower temperature of the lower belt 2. This temperature difference can be evaluated by the control unit 7 coupled with the temperature sensor 8 as the lack of the fibrous material web 1, i.e., as a tear.

In normal operation, the temperature sensor 8 arranged after the transfer of the fibrous material web 1 measures the relatively low temperature of the belt 2. However, when starting the machine, i.e., in this case transferring the fibrous material web 1 from the press section to the dryer section, initially the entire and later an increasing narrow strip of the fibrous material web 1 runs on the lower belt 2 into the machine cellar (not shown). This means that the temperature sensor 8 measures the relatively high temperature of the fibrous material web 1. The temperature sensor 8 does not detect the low temperature of the belt 2 until the fibrous material web 1 has been completely transferred. This means that the temperature drop makes it possible to conclude that the transfer of the fibrous material web 1 has been successful. If several temperature sensors 8 are arranged next to one another crosswise to the belt travel direction 4, the change in the width of the transferred strip of the fibrous material web 1 can be detected.

In the following dryer section, the fibrous material web 1 is guided over heated drying cylinders 6 and suctioned guide rolls by belts 3 in the form of drying screens, whereby the fibrous material web 1 comes into direct contact with the drying cylinders 6.

The drying cylinders 6 can be arranged in one or two rows. The belt 3 is diverted from last drying cylinder 6 at the end of the drying group. The fibrous material web 1 then runs on the drying cylinder 6 until accepted by a drying screen in a following drying group.

In the event that the drying screen is very wide-meshed, or the fibrous material web 1 runs unsupported on the drying cylinders 6, as is the case at the end of the drying group, a temperature sensor 8 can detect a tear in the fibrous material web 1 in the looping area of the drying cylinder 6. In normal operation the temperature sensor 8 measures the temperature of the fibrous material web 1 through the drying screen (if present at all). However, in the case of a tear, the substantially higher temperature of the drying cylinder 6 is detected. The control unit 7 can evaluate the abrupt jump in temperature as the signal for a tear.

The belt 3 is guided back over several guide rolls 12 from the last drying cylinder 6 of the drying group to the beginning of the drying group.

After this belt 3 is diverted from the fibrous material web 1, two possible temperature sensors 8 are shown here. After the separation of the fibrous material web 1, falsifications particularly from conditioning devices are still slight so that the measurement is very reliable.

Due to the heating element in the form of a drying cylinder 6, the temperature of the belt 3 is substantially lower than that of the fibrous material web 1, which also applies to the area of the belt 3 touched by the fibrous material web 1. However, in the case of a tear in the fibrous material web 1, the belt 3 comes into direct contact with the drying cylinders 6, which produces heating of the belt 3 over its entire width.

The temperature sensors 8 are designed as IR sensors, which renders possible temperature measurement without contact.

The control unit 7 coupled with the temperature sensors 8 evaluates the rapidity and the extent of the temperature differences. The temperature differences depend in this case also on the type of drying device. Temperature changes of 2 to 15° C. with heated drying cylinders 6, and of up to 35° C. with hot-air or infrared dryers can be evaluated as an indication of the lack of the fibrous material web 1 in the case of a tear or the addition of a part thereof during transfer. It is important, however, that the jumps in temperature take place quickly, i.e., within a period of 0.3 to 3 seconds. However, the time depends upon the installation location and the distance to the tear or the addition of the fibrous material web 1. The shorter the time, the closer the tear is.

When the control unit 7 detects a tear, on this basis, for example, the machine can be stopped and/or the fibrous material web 1 diverted purposefully into the machine cellar at a location located upstream.

If the control unit 7 detects the successful transfer of the fibrous material web 1 in this case between the press section and dryer section, draws can be closed, for example, or heating elements can be set to normal operation.

In order to obtain the most precise result possible, two temperature sensors 8 are always arranged very close together, whereby only temperature changes that are registered by both temperature sensors 8 are reported for evaluation. In addition, several of these pairs of temperature sensors 8 are arranged crosswise to the belt travel direction 4. There is a distance of between about 200 and 600 mm between these pairs. The measuring area of the temperature sensors 8 has a diameter of approx. about 40 to 80 mm.

Temperature sensors 8 are not just cost-effective, but are also insensitive with respect to the contamination of the belt 2, 3. Moreover, air jets and cooling devices permit the effect of the ambient air on the temperature sensor 8 to be minimized.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process to detect the presence of one of a paper, cardboard, tissue or other fibrous material web or a strip of the fibrous material web in machines for at least one of manufacturing and finishing the fibrous material web, whereby the fibrous material web is guided by at least one continuously circulating belt, said process comprising:

measuring at least one of (1) a temperature of a side of the fibrous material web opposite the at least one belt while it is being supported by the at least one belt, (2) a temperature of a material web supporting side of the side of the at least one belt after transfer of the fibrous material web to a following unit, and (3) a temperature of a side of the at least one belt opposite the fibrous material web supporting side of the at least one belt; and detecting a change in the at least one measured temperature as an indicator of the presence or lack of fibrous material or the strip in an area in the machine in the vicinity of the measuring.

2. The process according to claim 1, wherein the at least one belt comprises a plurality of belts and the temperature measurement takes place on several of the plurality belts.

3. The process according to claim 1, wherein the temperature measurement takes place at several locations along a run of the at least one belt.

4. The process according to claim 1, wherein the temperature measurement takes place at several locations crosswise to a direction of travel of the at least one belt.

5. The process according to claim 1, wherein the temperature measurement takes place without contact with respect to the at least one belt.

6. The process according to claim 1, wherein the temperature measurement takes place in an area of a press section for dewatering the fibrous material web, wherein the at least one belt comprises a press felt or a transfer belt.

7. The process according to claim 6, further comprising heating the fibrous material web before the temperature measurement by at least one heating element.

8. The process according to claim 7, said at least one heating element comprising at least one of a heated press roll and a steam blower box.

9. The process according to claim 1, wherein the temperature measurement takes place in the area of a dryer section for drying the fibrous material web, wherein the at least one belt comprises a drying screen.

10. The process according to claim 9, further comprising heating the fibrous material web before the temperature measurement by one of an IR radiator, a heated drying cylinder, and hot-air jets.

11. The process according to claim 7, wherein a temperature of the at least one belt in normal operation of the machine is lower than a temperature of the fibrous material web.

12. The process according to claim 11, wherein the temperature of a region of the at least one belt structured to support the material web drops when the fibrous material web or at least a part thereof is no longer present in the region.

13. The process according to claim 11, wherein, due to direct contact with the at least one heating element, the temperature of a region of the at least one belt structured to support the material web increases when the fibrous material web or at least a part thereof is missing in the region.

14. The process according to claim 1, further comprising supplying a result of the temperature measurement to a control unit, which evaluates the temperature measurement.

15. The process according to claim 14, further comprising measuring the temperature of the at least one belt outside an area structured to support the fibrous material web in order to determine a temperature comparison value.

16. The process according to claim 1, wherein detecting the temperature change includes at least one of a rate and a magnitude of the temperature change.

17. The process according to claim 16, wherein a temperature change of at least 10° C. within a period of a maximum of 3 s indicates the lack of or addition of at least the part of the fibrous material web running in the area of the temperature measurement.

18. The process according to claim 17, wherein a temperature change of at least 5° C. within a maximum period of 1 s, indicates the lack of or addition of at least the part of the fibrous material web running in the area of the temperature measurement.

19. The process according to claim 18, wherein a temperature change of at least 5° C. within a maximum period of 0.3 s, indicates the lack of or addition of at least the part of the fibrous material web running in the area of the temperature measurement.

20. The process according to claim 16, wherein at least one of the magnitude and rate of the temperature change is evaluated to detect the location of a tear in the fibrous material web.

21. The process according to claim 1, wherein the measurement of the temperature of the at least one belt takes place as quickly as possible after the transfer of the fibrous material web.

22. The process according to claim 15, further comprising, when detecting a tear in the fibrous material web, the control unit triggers a routine comprising at least one of: (1) transitioning into a tear operation, (2) reducing the heating capacity, (3) diverting the fibrous material web, and (4) shutting at least a part of the machine off.

23. The process according to claim 22, wherein when a tear is detected the heating capacity is controlled depending on the temperature of the at least one belt.

24. The process according claim 15, further comprising the control unit supplying a signal when detecting a successful transfer of the entire fibrous material web, which signal triggers a transition to the normal operation of the machine or at least a part of the machine.

25. A device to detect the presence of at least one of a paper, cardboard, tissue or other fibrous material web or a strip of the fibrous material web in machines for at least one of manufacturing and finishing the fibrous material web, whereby the fibrous material web is guided by at least one continuously circulating belt, the device comprising:

at least one temperature sensor located in an area in the machine in which the lack of or addition of the fibrous material web or a strip thereof produces a change in the temperature of the at least one belt; and said at least one temperature sensor being arranged to measure at least one of (1) a temperature of a side of the fibrous material web opposite the at least one belt while it is being supported by the at least belt, (2) a temperature of a web supporting side of the at least belt after transfer of the fibrous material web to a following unit, and (3) a temperature of the side of the at least one belt opposite the web supporting side of the at least one belt.

26. The device according to claim 25, said at least one temperature sensor comprising at least one of IR sensor and IR thermography camera.

27. The device according to claim 25, further comprising a cleaning element located proximate to said at least one temperature sensor.

28. The device according to claim 27, said cleaning element comprising an air jet.

29. The device according to claim 25, further comprising a cooling device allocated to said at least one temperature sensor.

30. The device according to claim 25, said at least one temperature sensor comprising a plurality of temperature sensors arranged next to one another crosswise to the belt travel direction.

31. The device according to claim 30, wherein the distance between each temperature sensor is between about 100 mm and 1000 mm.

32. The device according to claim 31, wherein the distance between each temperature sensor is between about 200 mm and 600 mm.

33. The device according to claim 32, said at least one temperature sensor having a measuring area with a diameter between about 20 mm and 200 mm.

34. The device according to claim 33, said at least one temperature sensor having a measuring area with a diameter between about 20 mm and 100 mm.

35. The device according to claim 25, said at least one temperature sensor comprising two temperature sensors arranged close to one another as a pair.

36. The device according to claim 25, said at least one temperature sensor embodied to be traversable crosswise to the fibrous material web.

37. The device according to claim 25, wherein said at least one temperature sensor comprises a temperature sensor located on opposite sides of a transfer roll.

38. The device according to claim 25, said at least one temperature sensor being located in a press section of the machine.

39. The device according to claim 25, said at least one temperature sensor being located in a dryer section of the machine.

40. The device according to claim 39, wherein said at least one temperature sensor is located to measure a temperature of the side of the at least one belt opposite the web supporting side of the at least one belt, where the at least one belt is supported by a heated drying cylinder.

41. The device according to claim 39, wherein said at least one temperature sensor is located to measure a temperature of the side of the at least one belt opposite the web supporting side of the at least one belt, where the at least one belt is unsupported.

* * * * *